United States Patent [19]

Konnikov et al.

[11] 3,964,209

[45] June 22, 1976

[54] SEMIAUTOMATIC DIAMOND TOOL-GRINDING MACHINE

[76] Inventors: Mikhail Naumovich Konnikov, ulitsa Kosmonavtov, 5, kv. 35, Vitebsk; Ivan Savvich Nakul, ulitsa Vyshgorodskaya 33, kv. 35, Kiev; Leonid Kuzmich Novikov, Smolenskoe shosse, 58, kv. 49, Vitebsk; Evgeny Stepanovich Zemlyansky, ulitsa Osipovskogo, 13, kv. 14; Peter Tankhomovich Shulman, ulitsa Dorogozhitskaya, 26, kv. 58, both of Kiev, all of U.S.S.R.

[22] Filed: Mar. 12, 1974

[21] Appl. No.: 450,497

[52] U.S. Cl. ..... 51/5 R; 29/33 R; 76/82

[51] Int. Cl.[2] ..... B24B 3/34

[58] Field of Search ..... 51/5 R, 5 B, 327, 325, 51/323, 74 BS, 109 BS; 29/33 R; 76/82, 85, 88

[56] References Cited

UNITED STATES PATENTS 3,751,855 8/1973 Pinat ..... 51/5 R

*Primary Examiner*—Frank T. Yost

*Attorney, Agent, or Firm*—Haseltine, Lake & Waters

[57] ABSTRACT

A semiautomatic diamond tool-grinding machine performing several grinding operations in a single pass, at a single setting of the tool to be ground, including diamond wheels: one for grinding the rear edges of a hard-alloy element, the other for grinding a chip-breaking groove, both wheels being affixed to the spindle of a grinding head disposed on the base of the machine, the base also carrying a horizontally displaceable stop to adjust the amount of the cut-off allowance removed off the rear surface of the tool, and a milling head which, upon dressing the tool holder over its rear surface, permits grinding of the hard-alloy element without the diamond wheel touching the tool holder.

4 Claims, 8 Drawing Figures

SEMIAUTOMATIC DIAMOND TOOL-GRINDING MACHINE

The present invention relates generally to the machinetool industry and more specifically to semiautomatic diamond tool-grinding machines.

The invention can be effectively employed for primary grinding of tools at specialized factories and also for primary grinding and periodic re-grinding of tools at machine-building factories and other enterprises.

The invention can be also utilized for dressing hardalloy armoured blades used on wood-working machines, and die components made of hard alloys.

Grinding of tools whose holder is fitted with a hardalloy element is at the present time performed by machines which perform preliminary grinding by an abrasive wheel over the rear surfaces of the hard-alloy element together with the tool holder.

Afterwards, another machine is used for final grinding by a diamond wheel over the rear surfaces of the hardalloy element only.

Yet, grinding a chip-breaking groove is carried out on a special machine, wherein diamond or abrasive wheels are employed.

The existing technology has a number of inherent disadvantages: low productivity due to frequent reinstalling of the tool from one machine to another; a great floor area required for the equipment needed for performing all necessary operations; insufficient durability of a tool handled due to the defects occurred in the surface layer of the hard-alloy element (scorching, microcracks) in the course of grinding by an abrasive wheel.

The abrasive wheel grinding of tools whose holder is fitted with a hard-alloy element requires a considerable number of said wheels as they are aptly consumed, which brings more difficulty to the manufacture in procuring the abrasive wheels of the needed bond and hardness, providing storage facilities necessary balancing of the wheels, removal of great amounts of sludge, etc. Apart from that, the extensive usage of abrasive wheels contaminates the air around the working places, causing professional diseases of the personnel.

Known in the art is a semiautomatic diamond tool-grinding machine for tools having a holder fitted with a hard-alloy element, which is used for dressing the rear surfaces of the hard-alloy element only, by a diamond wheel in a multi-pass grinding method.

A tool in this semiautomatic machine is clamped by a device installed on the base by means of hydraulic drives or manually, while the grinding head is given a reciprocating motion along the end face of the grinding wheel and a lateral motion for removing the grinding allowance.

This known semiautomatic machine permits grinding of the rear surfaces of the tool hard-alloy element by a diamond wheel only after the preliminary dressing of the tool holder. A chip-breaking groove cannot be ground by this semiautomatic machine.

The disadvantages of the known semiautomatic machine are as follows:

Dressing of the holder is not possible while ensuring favourable conditions for grinding the hard-alloy element by a diamond wheel;

No grinding is possible of a chipbreaking groove; the used multi-pass grinding method is not the best one as to productivity.

It is a principal object of the invention to improve semiautomatic diamond tool-grinding machines for tools having a holders fitted with hard-alloy elements, with the aim of making them suitable to effect several operations at a single setting of the tool.

This and other objects are achieved in this invention in a semiautomatic diamond tool grinding machine for tools having a holder fitted with a hard-alloy element, wherein the base of the machine mounts a work table which is kinematically linked with a reciprocating drive and has a device for setting the handled tool; the setting device includes a mechanism for automatic clamping and releasing of the tool, and it is installed at an angle affording the required rear cutting angle of the tool; and a grinding head for grinding the rear surfaces of the tool, provided with an individual drive for the rotation of its spindle.

According to the invention, the grinding head spindle carries diamond wheels; one wheel for grinding the hard-alloy element over its rear surfaces, the other wheel for grinding a chip-breaking groove. These wheels are installed with a possibility for adjusting the interval between them to ensure the required position of the chip-breaking groove in relation to the main cutting edge.

According to further inventive features, the base mounts a stop displaceable in a horizontal plane for adjusting the amount of the cut-off allowance removed off the tool rear surface, which stop orients the tool setting with respect to its rear surface and contacts the front surface of the tool by thrusting the latter by a flexible element installed on the work table.

There is also provided a milling head for dressing the tool holder over its rear surface, the spindle of the latter head being inclined in relation to the spindle of the grinding head at an angle which, upon milling the tool holder over its rear surface, permits grinding of the hard-alloy element over its rear surfaces without touching the the tool holder with the diamond wheel.

This semiautomatic machine permits diamond grinding of tools at a single setting of the tool and single pass. This, in its turn, leads to an increased productivity of the semiautomatic machine.

Besides, the proposed semiautomatic machine allows a considerable reduction of the floor area occupied by the equipment needed for performing all tool grinding operations It is recommended that the milling head be provided with an eccentric sleeve whose turning allows for the setting displacement of the milling-head spindle, secured in the sleeve, to provide optimum conditions for grinding the hard-alloy element at its joining the tool holder.

Positioning of the milling cutter spindle inside the eccentric sleeve simplifies the structure of the semiautomatic grinding machine and makes its attendance easier when slight displacements of the milling cutter are necessary in a vertical plane.

It is furthermore suggested by the invention that the stop embody two planes or surfaces, one of them contacting the front surface of the tool to determine its position in relation to peripheral surfaces of the diamond wheels, in grinding the chip-breaking groove, and the other surface contacting the rear surface of the tool to determine its position with respect to the end faces of the diamond wheels in grinding the hard-alloy element over its rear surfaces.

Provision of the stop embodying two planes allows the tool to be installed in such a position that all three operations (milling of the holder, grinding of the rear edge of the hard-alloy element, and grinding of the chip-breaking groove) can be performed in a single pass.

A further, similarly optional feature of the present invention is that the grinding head incorporates a device for the vertical setting displacement of the grinding-head spindle in relation to that surface of the stop which is in contact with the tool front surface to obtain the required depth of grinding the chipbreaking groove.

Vertical displacement of the grinding head is a feature of convenience when setting-up the machine to operate with a diamond wheel of another size, in adjusting the depth of grinding the chip-breaking groove, and also in dressing closed-type grooves.

Other objects and features of the present invention will be apparent from the following description of an exemplary embodiment of the invention with reference to the accompanying drawings, in which.

Figure 1:
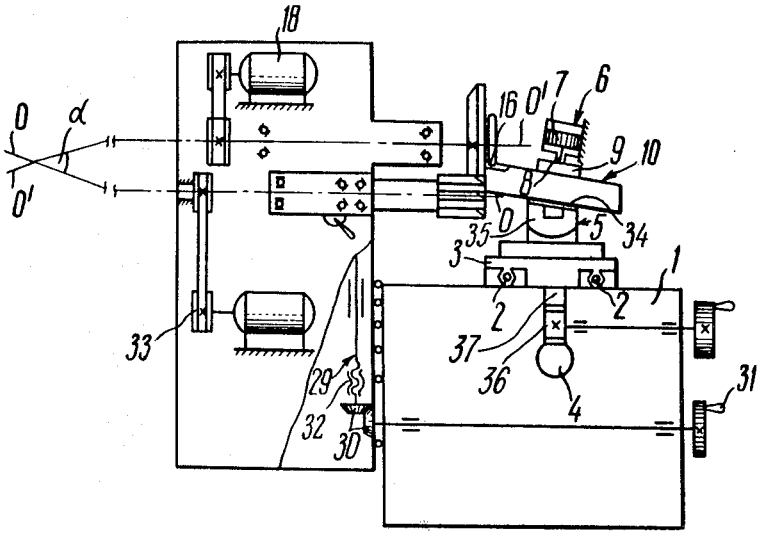
FIG. 1 is the inventive schematic side view of a semiautomatic diamond tool-grinding machine.

Referring now to the drawings, the novel semiautomatic diamond tool-grinding machine comprises a base 1 (FIG. 1) in whose front portion is located a work table 3 resting on ball guides 2 and kinematically linked with a drive 4 imparting the table a reciprocating motion. The drive embodying a hydraulic cylinder is secured to the base 1. The work table 3 mounts a device 5 for setting a tool to be ground including a mechanism 6 for automatic clamping and releasing of the processed tool (identification by numeral follows later). The mechanism embodies a hydraulic cylinder 7, whose rod 8 is connected to an upper movable part 9 of the device 5.

By way of explanation it might be added that the hydraulic system of the drive 4 is linked with the work table 3, the displacement of the latter being effected by a portion of the hydraulic cylinder, as mentioned before. The work table 3 is also adapted for manual movement with the aid of a rack-and-pinion mechanism that will be explained somewhat later (parts 36, 37).

The device 5 for clamping and releasing the tool to be sharpened or ground is installed at an angle ensuring the preset rear cutting angle of the tool for obtaining optimum cutting conditions in its use.

In order that the invention be more clearly understood and the description made simpler, the terms "rear surfaces of the hard-alloy element" and "rear surfaces of the holder" should be understood as the rear surfaces of the tool. The tool shown in FIG. 1 is identified by reference numeral 10, a main cutting edge of the tool shown in FIG. 2 has numeral 11, a rear surface of the tool shown in in FIG. 3 has numeral 12, a front surface of the tool shown in FIG. 3 is 13, a holder of the tool shown in FIG. 3 has numeral 14, a hard-alloy element of the tool shown in FIG. 1 is 15, and a chipbreaking groove of the tool shown in FIG., 1 is 16.

The base 1 mounts a hard-alloy grinding head 17 (FIG. 2) for grinding the tool over its rear surfaces 12 (FIG. 3), which head is provided with a drive 18 (FIG. 1) for rotating the spindle of the head.

According to the invention, the base 1 carries a stop 19 (FIG. 2) which is displaceable in a horizontal plane and serves for adjusting the cut-off allowance removed off the rear surface 12 of the tool.

Secured to the spindle (not shown in the drawings) of the grinding head 17 are diamond wheels 20, 21, of which the wheel 20 is adapted for grinding the head 17 over its rear surfaces 12, whereas the other wheel 21 is used for grinding the chip-breaking groove 16. The diamond wheels 20, 21 are installed with a possibility for adjusting the distance between them with the aim of obtaining the required position of the chip-breaking groove 16 with respect to the main cutting edge 11 (FIG. 2) of the tool.

For dressing the tool holder 14, the base 1 mounts a milling head 22 whose spindle (not shown in the drawings) carries a milling cutter 23. An individual drive 33 for the cutter will be described somewhat later. The geometrical axis 0—0 (FIG. 1) of the spindle of the milling head 22 is inclined in relation to the geometrical axis 0—0 of the spindle of the grinding head 17 at angle $\alpha$ which upon milling the tool holder 14 over rear surfaces 12 permits grinding of the hard-alloy element 15 over the rear surfaces 12 without the diamond wheel 20 touching the holder 14.

Due to the fact that the proposed semiautomatic grinding machine incorporates two diamond wheels 20 and 21 which are correspondingly adapted for grinding the hard-alloy element 15 over the rear surfaces 12 and for grinding the chip-breaking groove 16 of the tool, and the milling head for dressing the holder 14 over the rear surfaces 12 when the spindle of which latter the head is installed at an angle allowing the hard-alloy element 15 to be ground over the rear surfaces 12 without the diamond wheel 20 touching the holder 14, it is possible to perform several tool-grinding operations at a single setting of the tool and by applying a single-pass method of machining. This, in turn, sharply increases the productivity of the semiautomatic machine. Besides that, it should be noted that the condition when the diamond wheel does not touch the holder, which is basically made of steel, brings forth an advantage of prolonging the service life of the diamond wheel as it is prevented from glazing.

In FIG. 1, numerals 36, 37 identify a rack-and-pinion system for moving the work table 3, as has been mentioned before. It will be understood that the work table 3 can be moved lengthwise manually with the help of the mating gear 36 and rack 37 when the machine has to be adjusted to grind non-standard tools.

To simplify the design of the semiautomatic grinding machine and to make its attendance easier when it is necessary in the given case to effect relatively slight displacements of the milling cutter in a vertical plane, the milling head 22 incorporates an eccentric sleeve (38 FIG. 2) inside which the spindle of the milling cutter 23 is secured. Turning of this sleeve affords a setting displacement of the spindle and consequently that of the milling cutter 23 as well, to establish optimum conditions for grinding the hard-alloy element over the rear surfaces at the place of its joining the holder.

In FIG. 3, numeral 39 identifies a vertical rod of the table 3, below the setting device 5. The latter device, with the tool 10 secured therein, can be raised until contact is made along the plane of the tool, along its rear surface 13, with the help of the rod 39 that is connected with the device 5.

These optimum conditions are characterized in that the diamond wheel, in the course of grinding the hard-alloy element over the rear surfaces, will not come in contact with the steel holder of the tool and consequently will not become glazed, thus enabling the diamond wheel to keep its cutting ability.

According to the invention, the stop 19 embodies two planes 24 (FIG. 3) and 25 with one of them, namely plane 24, contacting the front surface 13 of the tool, thus determining the position of the latter in relation to a peripheral surface 26 of the diamond wheel 21 for grinding the chip-breaking groove, whereas the other plane 25 contacts the rear surface 12 of the tool, thus determining the position of the latter in relation to an end face 27 of the diamond wheel 20, adapted for grinding the hard-alloy element 15 over the rear surfaces 12.

This stop embodiment permits a single setting of the tool 10 in a position for performing all three operations of its grinding (milling of the holder, grinding of the rear surfaces of the hard-alloy element and grinding of the chip-breaking groove) in a single pass.

Contact between the stop 19 and the front surface 13 of the tool 10 is effected by thrusting the latter to the corresponding plane 24 of the stop 19 with the help of a flexible element embodying springs 28 installed precompressed in a spread between the work table 3 and the tool-setting device 5.

To obtain the required depth of the chip-breaking groove, the grinding head 17 comprises a device for the vertical setting displacement of the spindle in relation to the surface 24 of the stop 19, which surface is in contact with the front surface 13 of the tool.

Vertical adjustment of the grinding head 17 gives more convenience when re-setting the semiautomatic machine to operate with a diamond wheel of another size, also in adjusting the depth of grinding the chip-breaking groove, and in dressing closed-type grooves.

The devide for the vertical setting displacement of the spindle embodies a screw pair 29 (FIG. 1) and a bevelgear pair 30, the latter pair kinematically linked with a handle 31 for setting the diamond wheel 21 for the required depth of grinding the chipbreaking groove and also with the screw pair 29 whose nut 32 is rigidly fixed in the body of the grinding wheel 17.

The milling cutter 23 is brought into rotation from the earlier-mentioned drive 33.

The milling head 22 is mounted on a transverse slider and consists of a body 41, in the bore of which there is mounted an eccentric sleeve 42 (see also part 38), the former with a spindle 43. A spur gear 44, kinematically connected to a handle 45, is mounted on the face of the sleeve 42. The gear 44 has its end faces entering a slot of a fork 46 which is coupled to a square member 47 through a screw and a nut. The spindle 43 is mounted in anti-friction bearings. One end of the spindle carries a milling cutter 48 (see also part 23) secured by a bar 49, and the other end carries a pulley 50. A rod 51 is mounted on the front wall of the body 41. One end of the rod carries a lever 52 with a preferably hard-alloy support 53 and a step 54. The rod 51 is connected through a strap 55 to a screw 56 having a know 57 with a dial 58.

In order to set up the milling cutter 48 at a definite height relative to the support 53, under which is located the cutting edge of the cutter 48, the handle 45 is turned, thereby turning the gear 44 through the kinematic link, together with the sleeve 42. The latter rotates, depending on the direction of the rotation of the handle 45; therefore the cutter 48 is raised or lowered. Axial movement of the cutter is effected by turning the square 47 so that the fork 46 moves the gear 44 together with the sleeve 42 along its axis.

The end face of the milling cutter 48 is set up, in the axial direction, with respect to the plane of the support 53, by the amount of the allowance to be removed from the cutter holder. During the adjustment of the milling cutter 48, the sleeve 42 is secured by means of a handle 59 and tangential clamps 60. The support 53 is mounted relative to the end face of the diamond wheel by turning the know 57 with the dial 58 by the amount of the allowance to be removed from the hard-alloy plate.

The rod 51 is fixed by a knob 61. The spindle 43 with the cutter 48 is rotated by a motor 62 through a pulley 63 together with the earliermentioned pulley 50, with a flat-belt transmission 64.

The body of a grinding head 65 (see also part 17) is mounted in guides of an upright 66 which is fixed on the transverse slider. A spindle 67 is mounted in the body of the grinding head 65 in anti-friction bearings with a conical end mandrel 68, with diamond wheels 69, 70 (see also the wheels 20, 21). The mandrel is secured in the spindle 67 by means of a stick 71. A pulley 72 is connected to the motor 62 through a belt drive 73.

The wheel 70 has a flange 74, moved with respect to the end face of the wheel 69 by a screw 75 after releasing a nut 76. After the wheel 70 has been set to the required position, the nut can be fixed.

The machine operates as follows.

A tool 10 to be ground is installed on a fixed support 34 of the device 5 turned on a swivelling support 35 through an angle equal to the angle of grinding the rear surface of the hard-alloy element 15. Upon pressing the start button, the mechanisms are energized and set into action so that the tool 10 is clamped between the fixed support 34 and the movable part of the device 5 by means of the hydraulic cylinder 7. Then, the device 5 together with the tool 10 secured herein is displaced by the action of the springs 28 of the flexible element to the extreme upper position until the front surface 13 of the tool 10 is brought into contact with the plane 24 of the stop 19.

Upon fixing the device 5 together with the tool 10 secured therein, the work table 3 is engaged for the longitudinal displacement effected by the drive 4. During this action the milling of the tool holder 14 is performed over the rear surface 12 and then simultaneous grinding of the hardalloy element 15 over the rear surface 12 by the diamond wheel 20, and grinding of the chip-breaking groove 16 by the diamond wheel 21.

Upon completion of the above actions, the grinding head 17 and the milling head 22 are kicked off for free return of the work table 3 with the tool 10 back to the initial position.

By way of further explanations, it might be added that the stop 19 is displaceable in the horizontal plane with guides by the use of a nut and a screw, in a conventional manner. The possibility of displacement is schematically indicated in FIG. 3.

The distance between the wheels 20, 21 is adjusted only by moving the wheel 21 with the aid of a screw (see FIG. 2), this wheel being supported by a movable sleeve (not shown).

It can be seen from FIG. 1 that the grinding and milling-head spindles are arranged at an angle alpha. This provides for milling the rear surface of the tool holder 14 at a certain angle, somewhat exceeding that of the rear surface 12 of the hard-alloy tool element 10. In this event the surface 12 is not the continuation of a surface of the tool holder 14, hence the wheel 20 does not contact the milled surface of the holder 14.

The structural linkage between the eccentric sleeve 38 and the milling head 22 has not been shown, but can be accomplished by turning the sleeve through the intermediary of a conventional worm pair.

Figure 2:
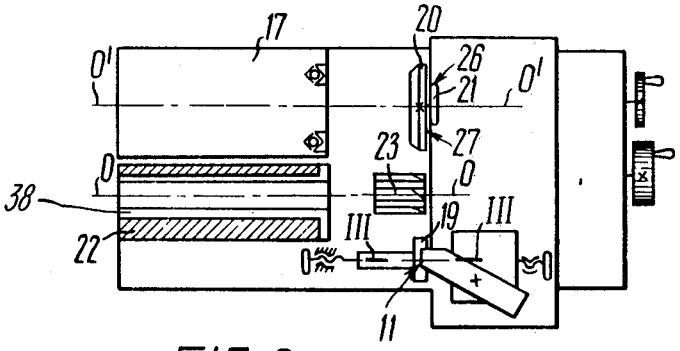
FIG. 2 is a schematic top view of the machine shown in FIG. 1.
Figure 3:
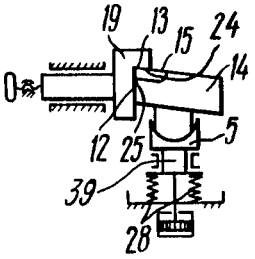
FIG. 3 is a sectional view along line III—III in FIG. 2.
Figure 4:
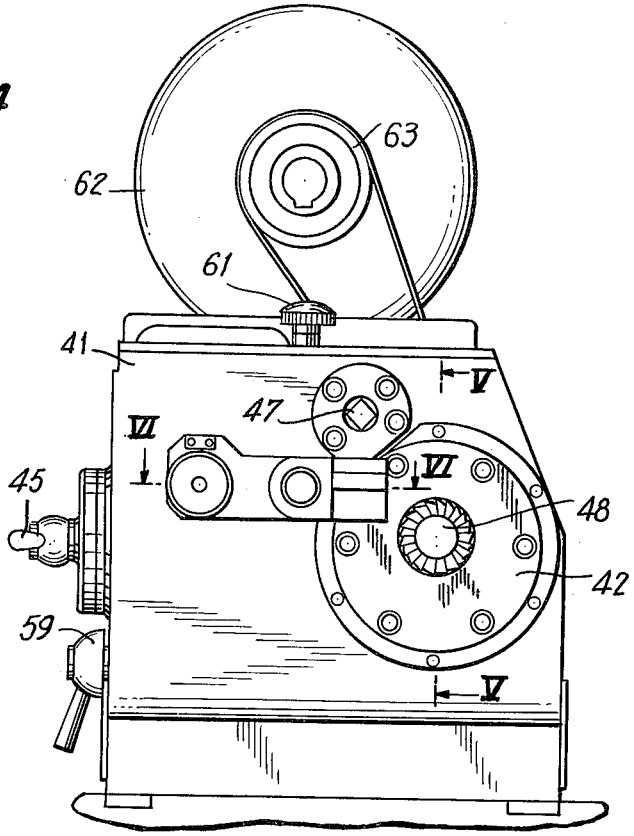
FIG. 4 is a front view of an exemplary milling head associated with the inventive grinding machine.
Figure 8:
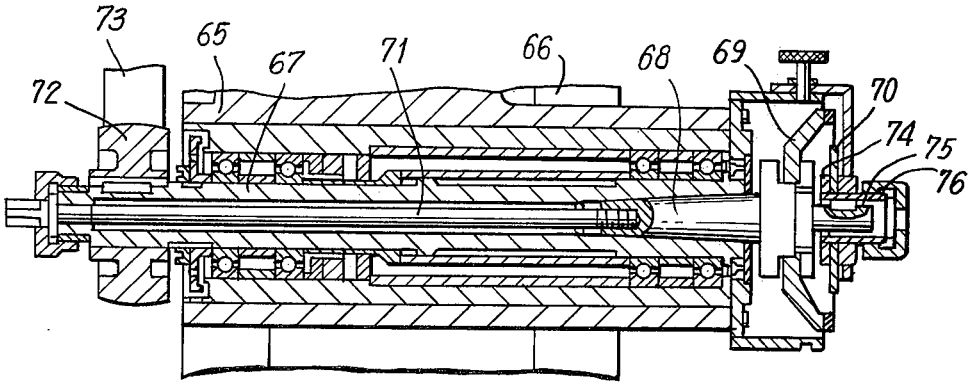
FIG. 8 is a longitudinal section of the grinding head of FIG. 4.
Figure 5:
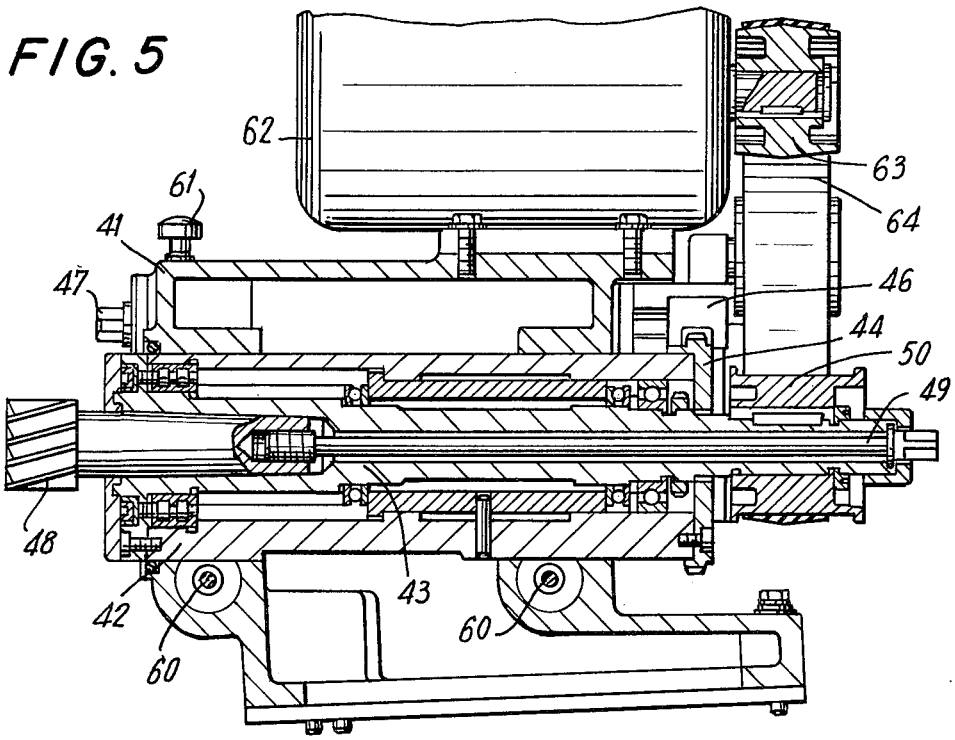
FIG. 5 is a sectional view taken along line V — V of FIG. 4.
Figure 6:
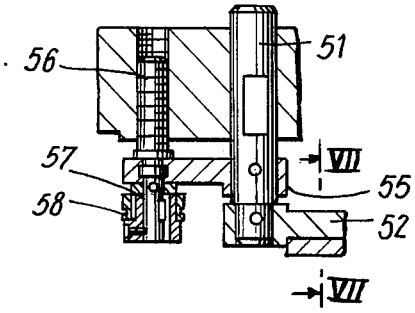
FIG. 6 is a similar sectional view but taken along line VI — VI of FIG. 4.
Figure 7:
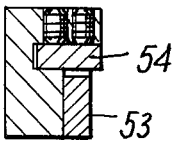
FIG. 7 is a sectional view taken along line VII — VII of FIG. 6.

FIG. 2 shows the cutter 23 in a fixed horizontal position. The cutter is adjusted in the vertical direction to prevent contact with the hard-alloy element 15, by turning the eccentric sleeve 38, which can be secured with a tangential screw (not shown).

The required position of the stop is determined by a trial sharpening of the tool 10, whereafter the stop can be set and secured. After orienting the tool with respect to the stop, the former is clamped by means of the cylinder 7. The tool is retained in the vertical position by clamping the rod 39 of the table.

Vertical displacement of the grinding spindle head 17 is effected by rotating the gear pair 30, by using the screw pair 29, and by operating the handle 31.

The swivelling support 35 is secured on the work table 3 and is adapted to set the tool 10 to the desired angle. Rotation is effected manually, whereafter the tool can be fixed in the desired position. Pushing the Start Button clamps the tool with the aid of the cylinder 7.

We claim:

1. A semiautomatic diamond tool-grinding machine for tools having a holder fitted with a hard-alloy element, comprising: a base (1); a work table (3) on said base; drive means (4) kinematically linked with said table for reciprocating the same; means (5) for setting a tool (e.g. 10) to be ground, installed on said table at an angle ensuring a preset rear cutting angle therefor; means (6) secured to said table for automatically clamping and releasing the tool; a flexible element (28) installed on said table; a horizontally displaceable stop (19) for adjusting the amount of cut-off allowance removed from the rear surface of the tool, said stop contacting the front surface of the tool by biasing the latter toward said flexible element; a grinding head (17) installed on said base and having a spindle; drive means (18) for rotating the latter; diamond wheels (20, 21) fixed to said spindle, one (20) of said wheels serving to grind a hardalloy element (e.g. 15) over its rear surfaces, and the other wheel (21) to grind a chip-breaking groove for the tool, said wheels being installed with freedom of adjusting the distance between them; and a milling head (22) installed on said base for dressing a tool holder (e.g. 14) and having a spindle whose geometrical axis is inclined in relation to that of said spindle of the grinding head.

2. The grinding machine as defined in claim 1, further comprising an eccentric sleeve in which said milling head (22) is installed, for displacing said milling-head spindle.

3. The grinding machine as defined in claim 1, wherein said stop (19) embodies two surfaces (24, 25), one (24) of which contacts the tool front surface, while the other surface (25) contacts the tool rear surface.

4. The grinding machine as defined in claim 3, wherein said grinding head (17) includes means (29 to 32) for vertical setting displacement of said spindle of the grinding head (17) in relation to one of said surfaces (24, 25) of the stop (19), which one surface is in contact with the tool front surface.

* * * * *